US007458383B2

(12) United States Patent
Song

(10) Patent No.: US 7,458,383 B2
(45) Date of Patent: Dec. 2, 2008

(54) WEFT FOR HAIR EXTENSION AND A METHOD OF EXTENDING THE WEFT FOR HAIR EXTENSION TO REAL HAIR

(76) Inventor: Ki Sun Song, Eunma Apt. 10-1207, Daechi-Dong, Gangnam-Gu, Seoul (KR)

( * ) Notice: Subject to any disclaimer, the term of this patent is extended or adjusted under 35 U.S.C. 154(b) by 578 days.

(21) Appl. No.: 10/884,870

(22) Filed: Jul. 2, 2004

(65) Prior Publication Data

US 2005/0061346 A1 Mar. 24, 2005

(30) Foreign Application Priority Data

Sep. 24, 2003 (KR) ..... 20-2003-0030201

(51) Int. Cl.
*A41G 3/00* (2006.01)

(52) U.S. Cl. ..... 132/201

(58) Field of Classification Search ..... 132/201, 132/53, 54–56
See application file for complete search history.

(56) References Cited

U.S. PATENT DOCUMENTS

| | | | | |
|---|---|---|---|---|
| 1,199,144 | A | 9/1916 | Zak | |
| 3,280,826 | A | 10/1966 | Jenkins | |
| 4,016,889 | A | 4/1977 | Cowles | 132/56 |
| 4,830,029 | A | 5/1989 | Bird | 132/54 |
| 5,072,745 | A | 12/1991 | Cheh | 132/201 |
| 5,121,761 | A | 6/1992 | Meister | 132/201 |
| 5,357,986 | A | 10/1994 | Hargrett | 132/201 |
| 5,413,124 | A | 5/1995 | Incando | 132/201 |
| 5,921,253 | A | 7/1999 | Jeong | 132/201 |
| 6,135,122 | A | 10/2000 | Campbell et al. | 132/201 |
| 6,405,736 | B2 | 6/2002 | Townsend | 132/201 |
| 6,510,856 | B1 | 1/2003 | Ahn | 132/219 |
| 6,513,535 | B1 * | 2/2003 | Lane | 132/201 |
| 6,581,609 | B2 | 6/2003 | Ott | 132/201 |
| 2006/0086368 | A1 * | 4/2006 | Salinas | 132/201 |

FOREIGN PATENT DOCUMENTS

| | | | |
|---|---|---|---|
| JP | 410077511 A | * | 3/1998 |
| JP | 410077512 A | * | 3/1998 |
| JP | 410077513 A | * | 3/1998 |
| JP | 410292216 A | * | 11/1998 |

* cited by examiner

*Primary Examiner*—Robyn Doan
(74) *Attorney, Agent, or Firm*—Volpe and Koenig, P.C.

(57) ABSTRACT

Disclosed is a weft for hair extension and a method of extending the weft for hair extension to real hair that provides a plurality of space portions through which the real hair is passed between a pair of wig hair bundles that are bound to form the weft for hair extension and fixedly extends the real hair that is passed through the space portions to the weft for hair extension by use of a plurality of pressure rings.

11 Claims, 13 Drawing Sheets

[Fig.1]
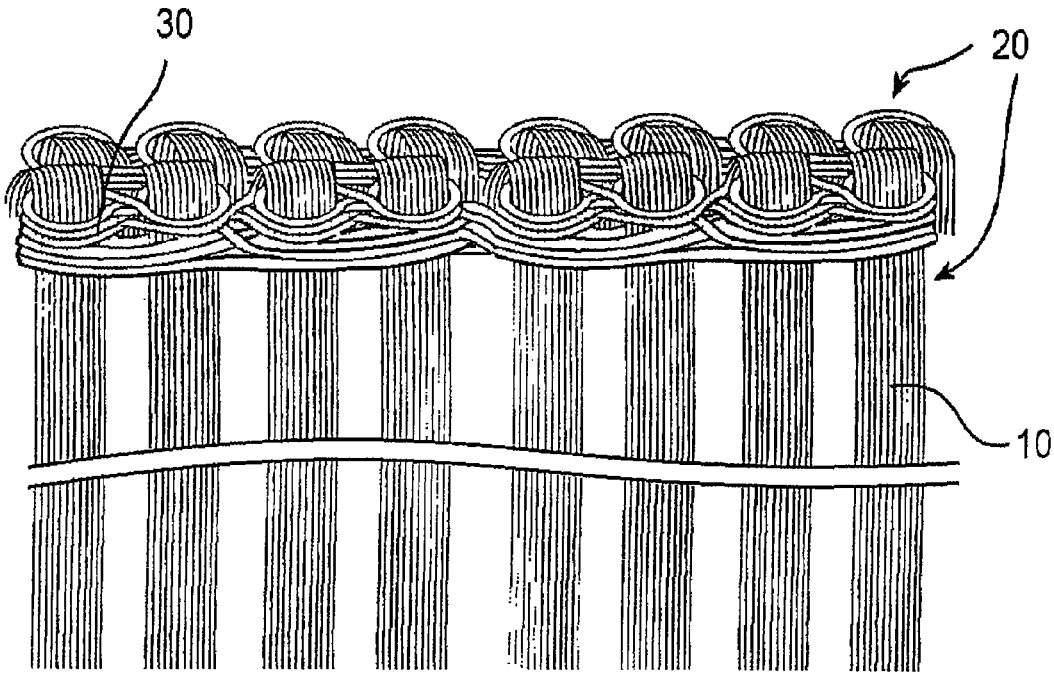
PRIOR ART

[Fig.2]
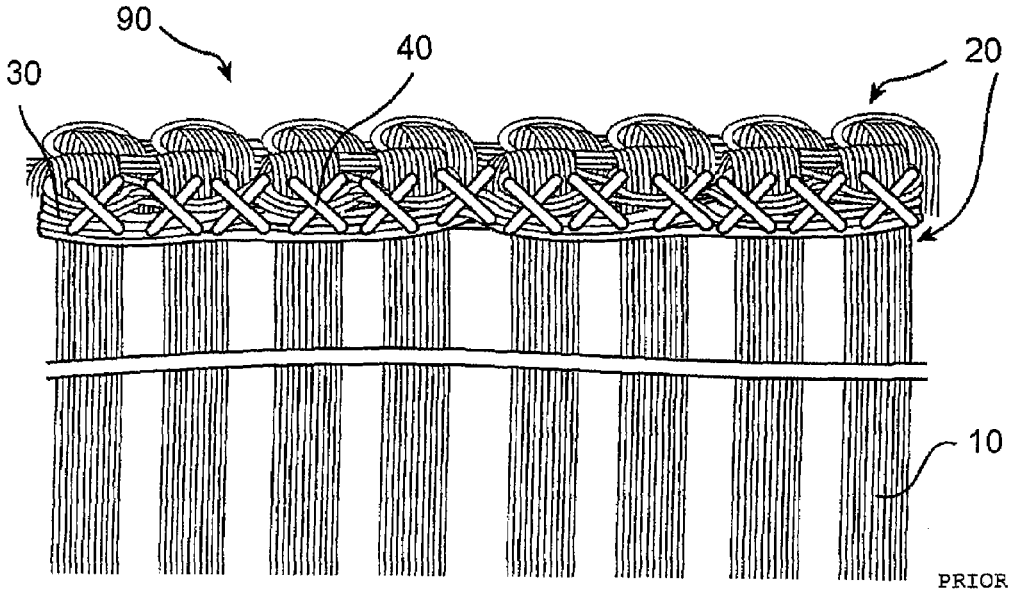
PRIOR ART
[Fig.3]
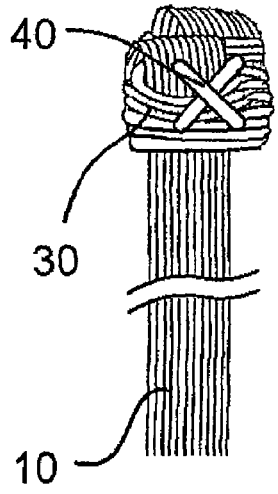
PRIOR ART

[Fig. 4]
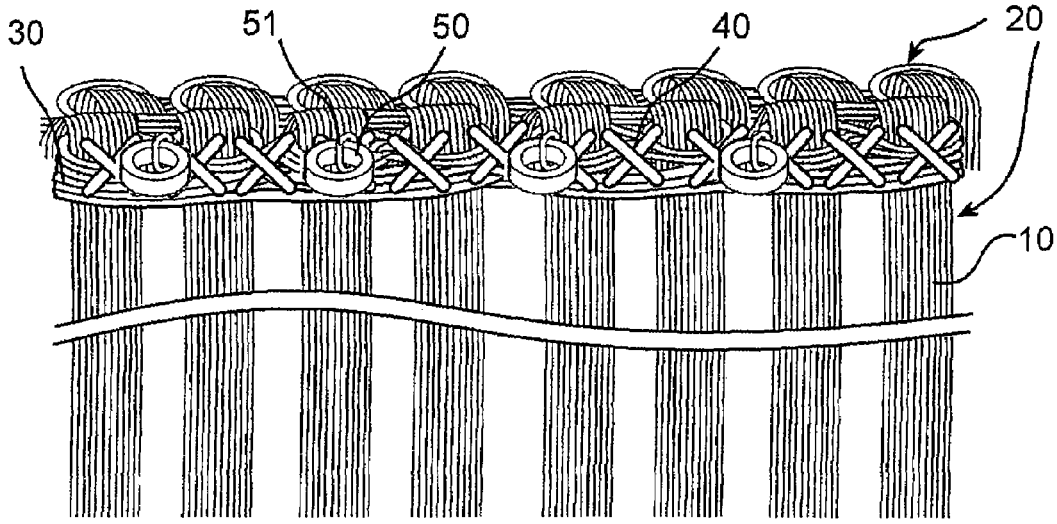
PRIOR ART

[Fig.5]
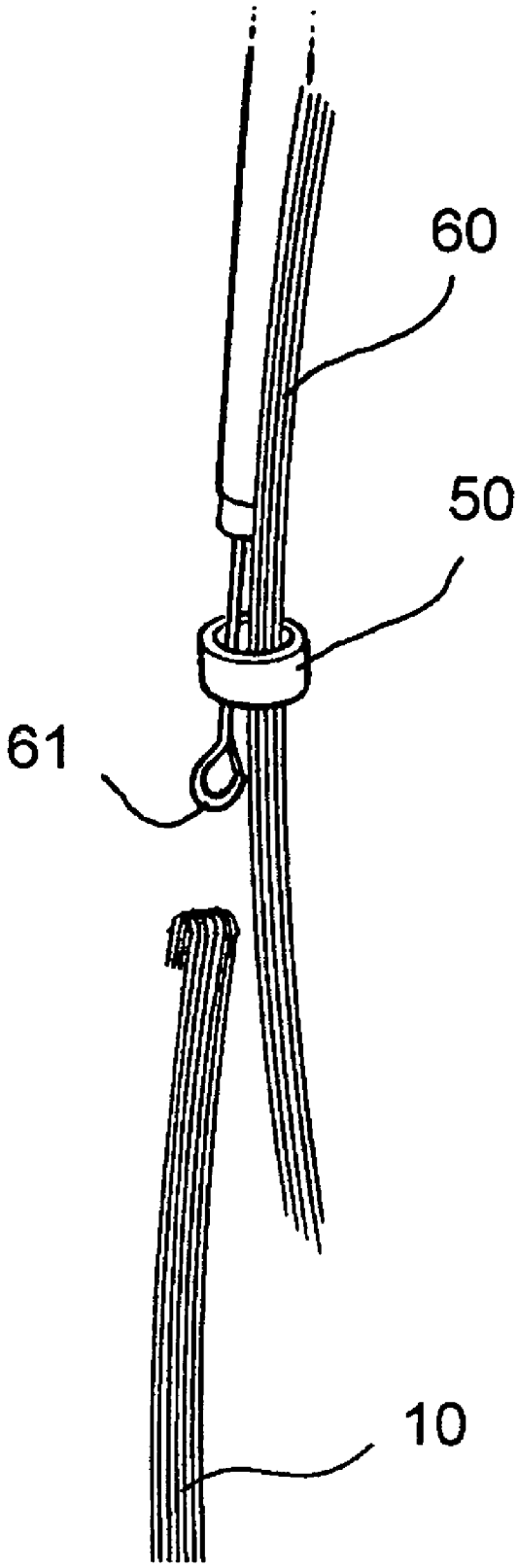

[Fig.6]
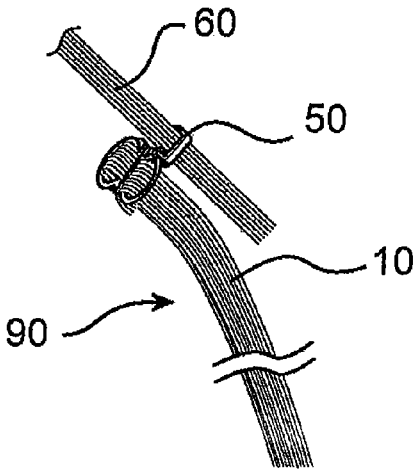
PRIOR ART
[Fig.7]
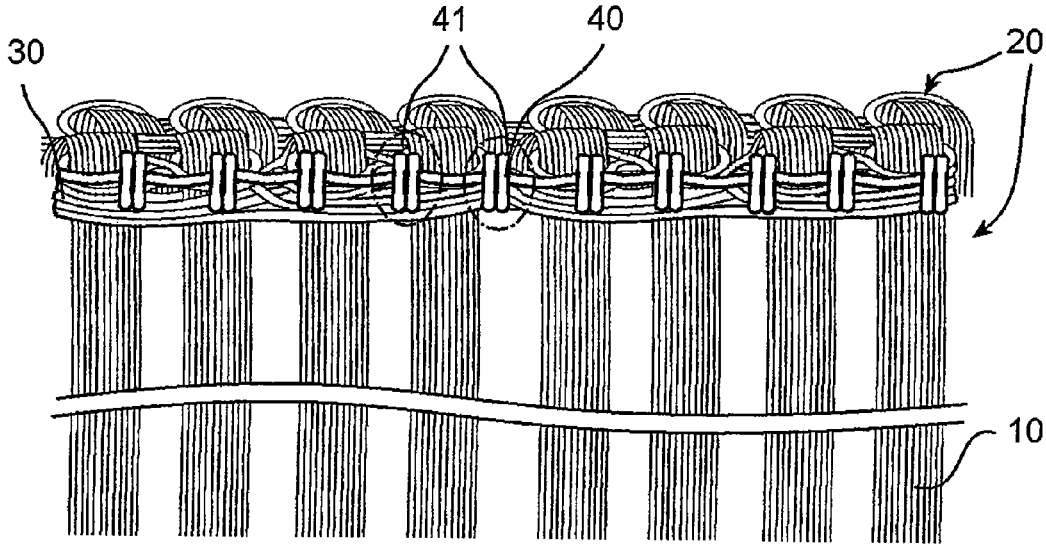

[Fig.8]
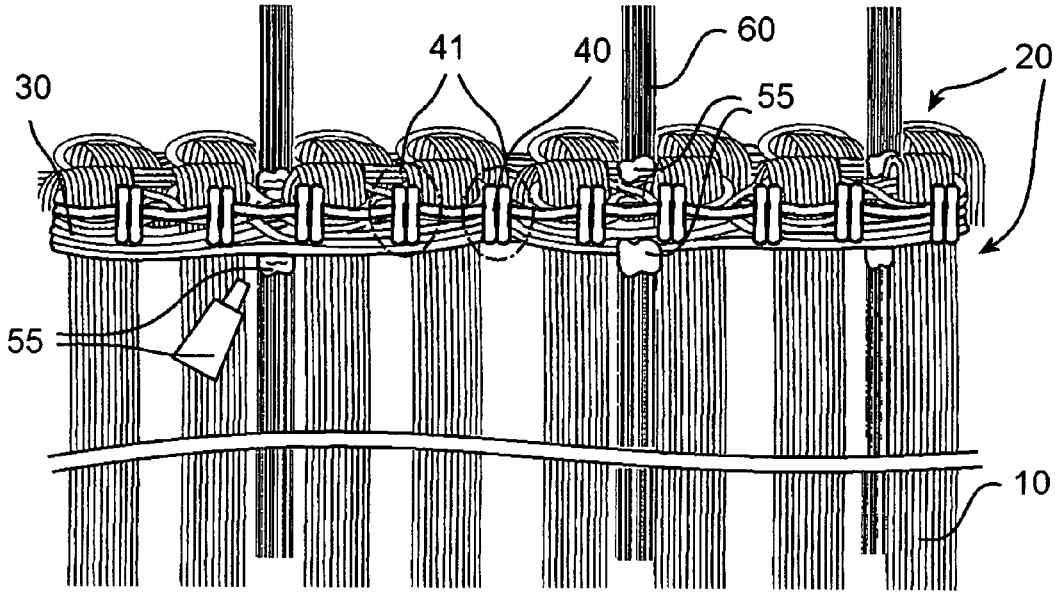
[Fig.9]
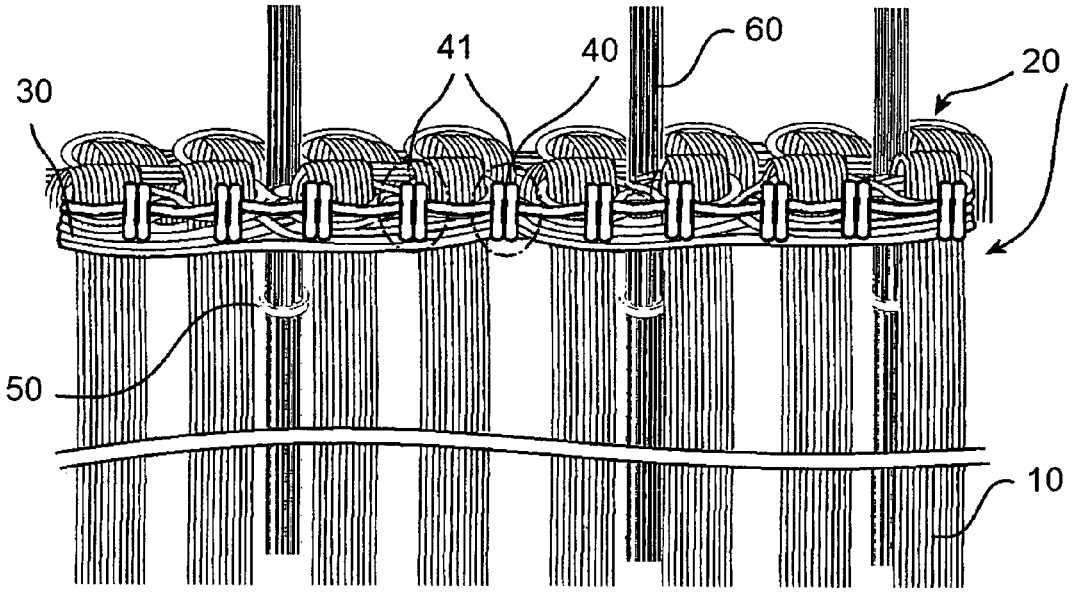

[Fig.10]
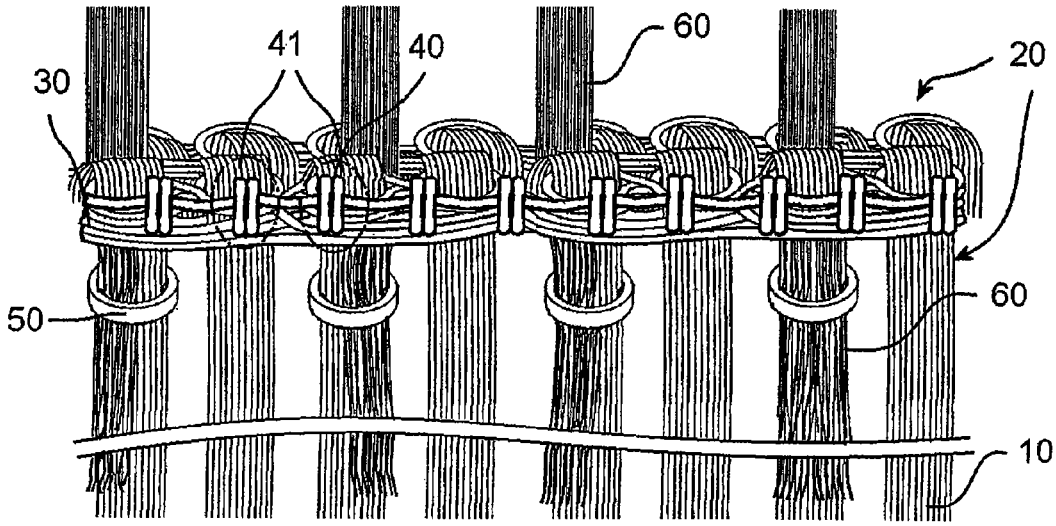
[Fig.11]
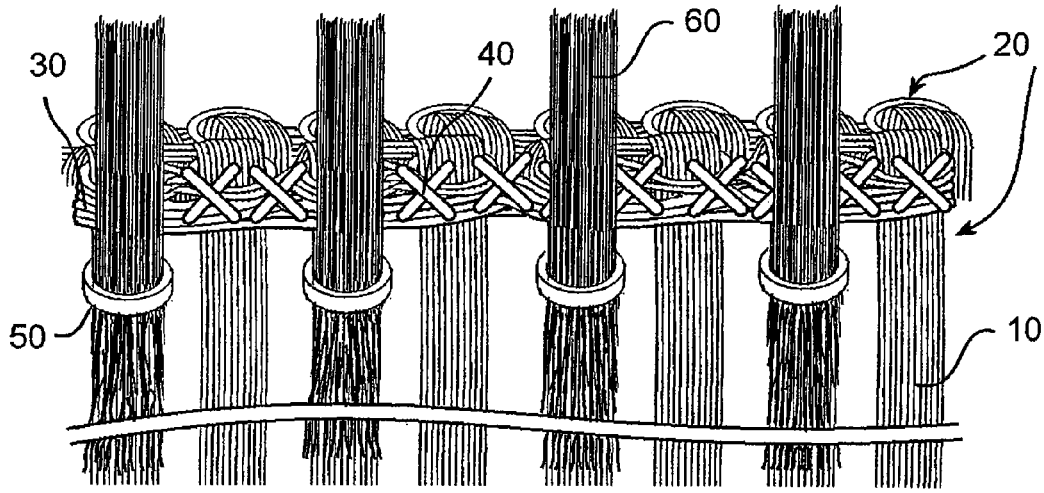
PRIOR ART

[Fig.12]
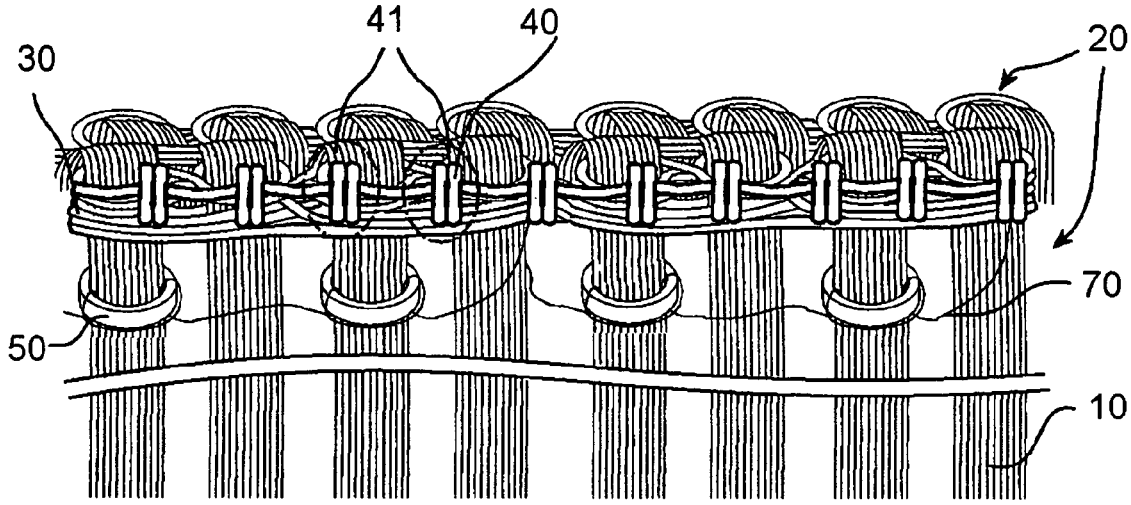

[Fig.13]
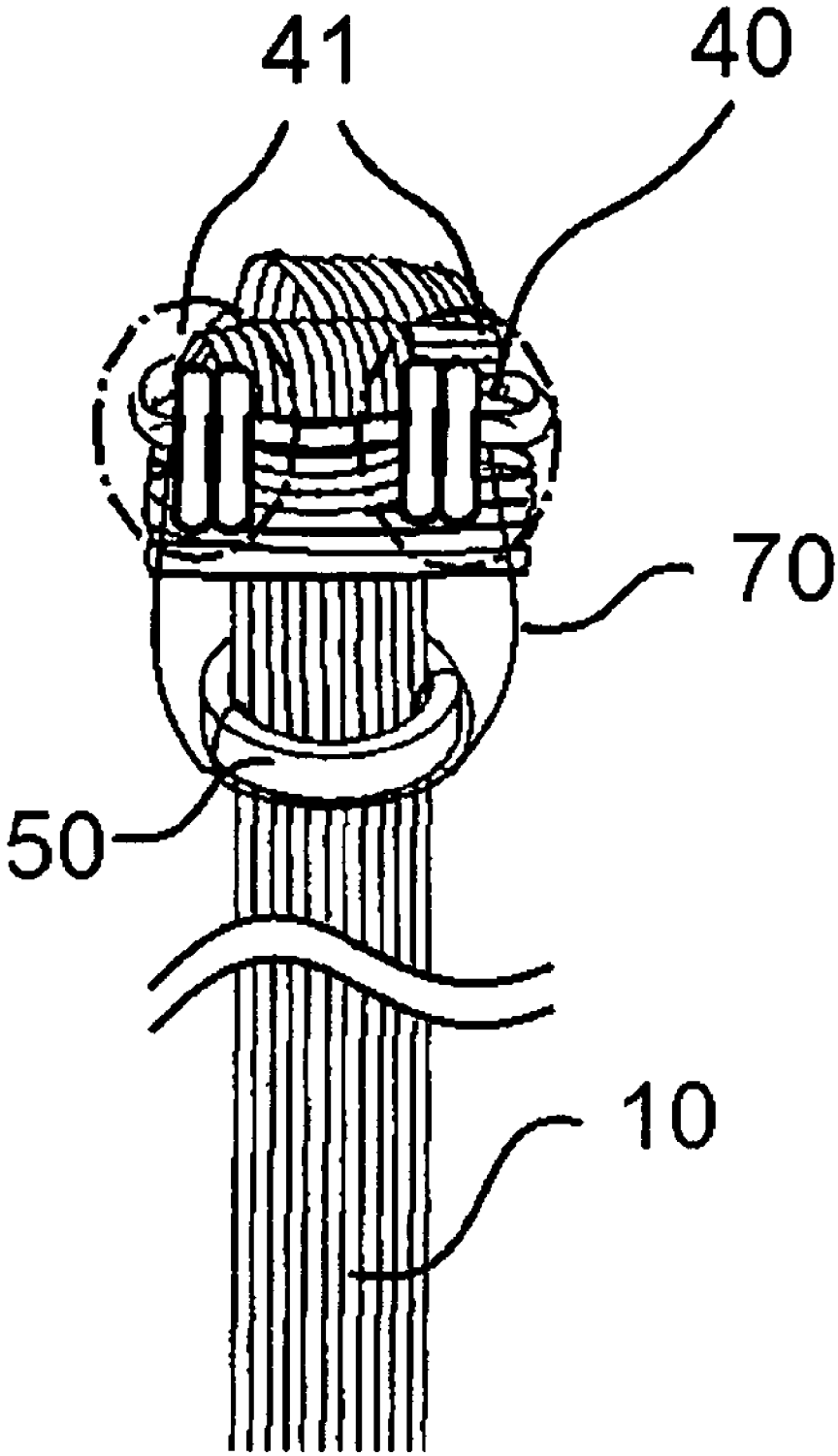

[Fig.14]
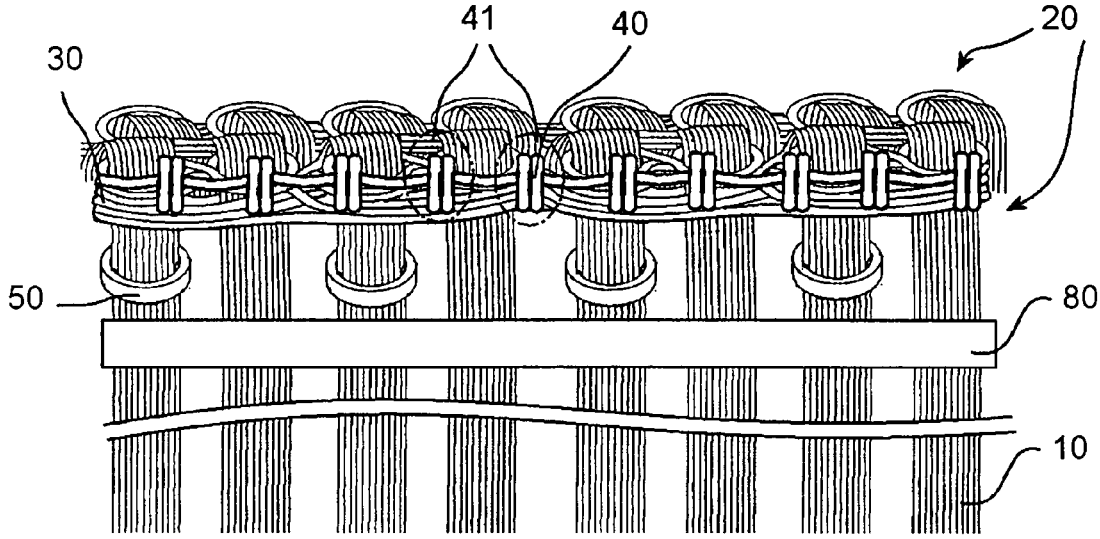
[Fig.15]
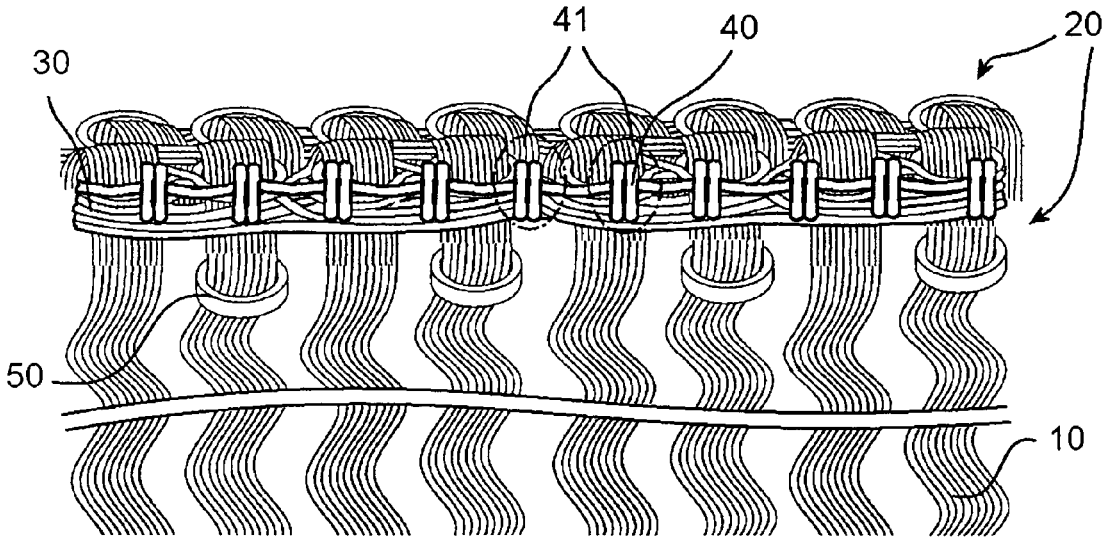

[Fig.16]
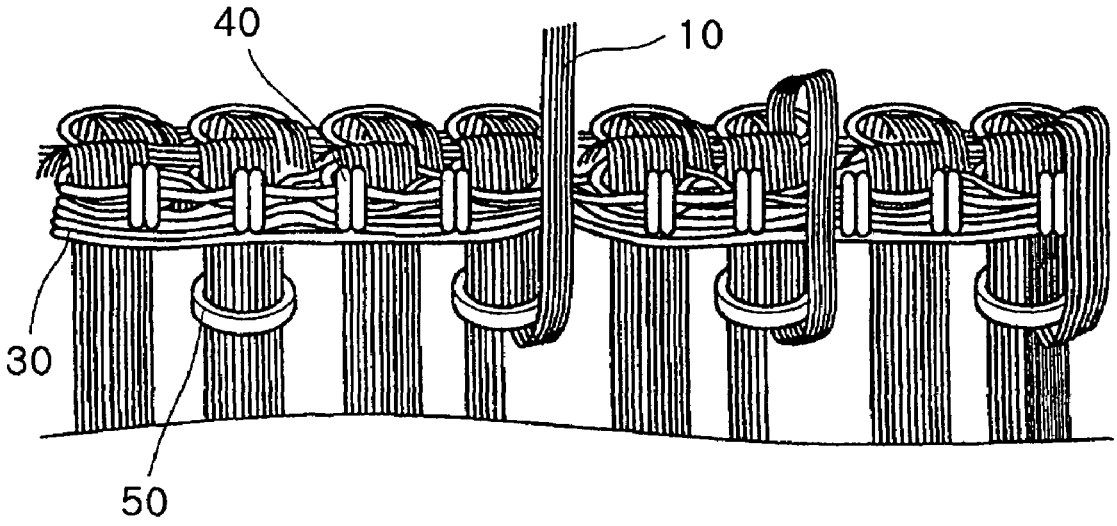

[Fig.17a]
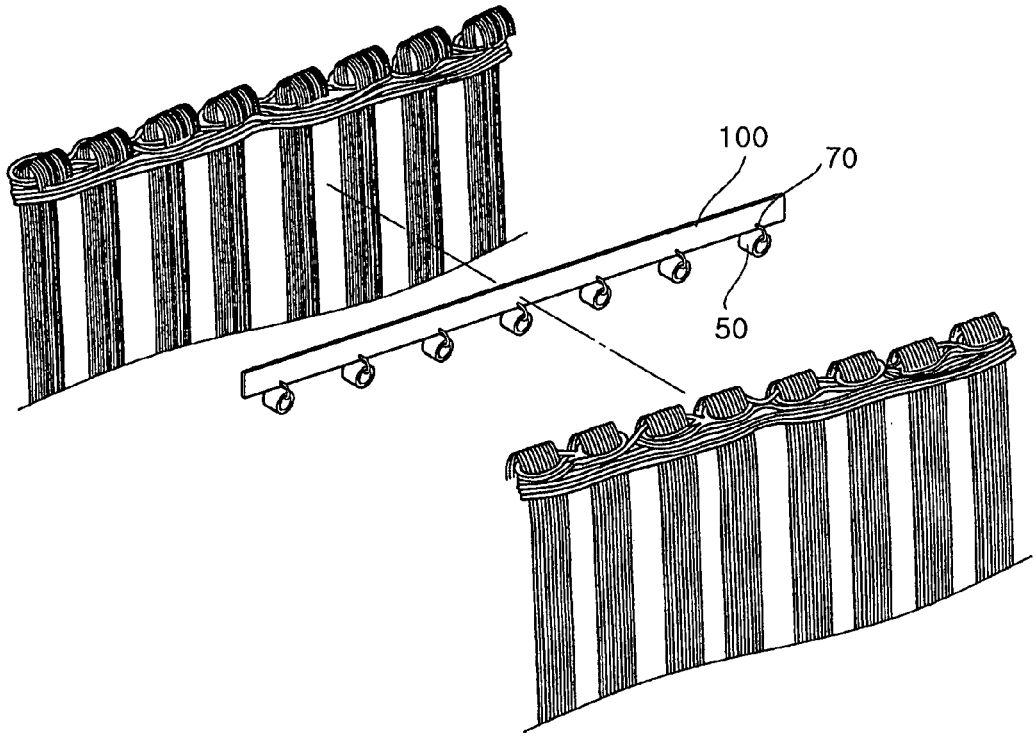
[Fig.17b]
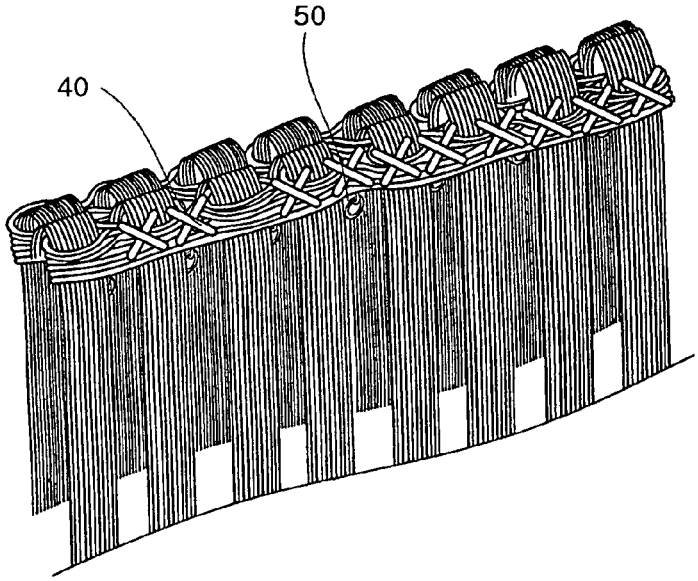

[Fig.18]
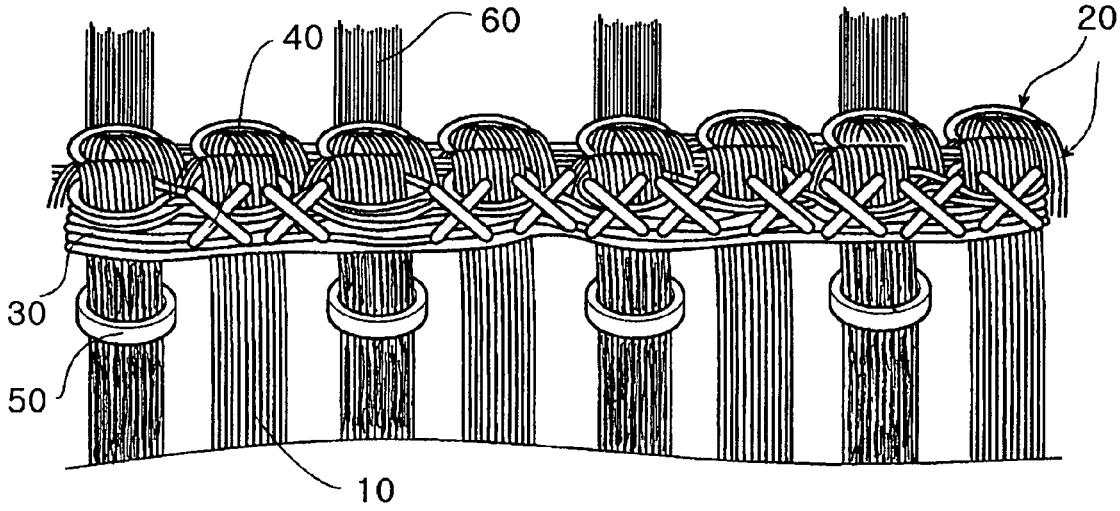

WEFT FOR HAIR EXTENSION AND A METHOD OF EXTENDING THE WEFT FOR HAIR EXTENSION TO REAL HAIR

BACKGROUND OF THE INVENTION

1. Field of the Invention

The present invention relates to a weft for hair extension and a method of extending the weft for hair extension to real hair, and more particularly, to a weft for hair extension and a method of extending the weft for hair extension to real hair that provides a plurality of space portions through which the real hair is passed between a pair of wig hair bundles that are bound to form the weft for hair extension and fixedly extends the real hair that is passed through the space portions to the weft for hair extension by use of a plurality of pressure rings.

2. Background of the Related Art

In old days, wigs were just used to cover a baldhead, but as people have tried to develop their beauty with various kinds of materials, recently, they are widely used as the instruments creating new fashion modes.

Especially, young people like to have hair extension of a variety of colors and shapes for extension with their real hair, and as one of the examples of the hair extensions, there is provided a weft for hair extension that is provided with a pair of wig hair bundles as shown in FIG. 1. The pair of wig hair bundles are formed by connecting the top end portions of a plurality of horizontally wig hair ties to one another by means of a connecting thread and bound together by means of a binding thread, as shown in FIG. 2. For the convenience of delivery and storage of wig hair, in old days, the weft for hair extension was used in a shape of a wig hair bundle or planted in a wig cap to constitute the wig. In recent days, however, it is widely used as hair accessories or fashion instruments for hair extension by young generations who always enjoy new fashion modes. As well known, various kinds of hair extensions have been developed and used by Europe and America, especially, by black people.

In size of the weft for the hair extension, it is formed of a plurality of wig hair ties 10, as shown in FIG. 1, or it is formed of an individual wig hair tie, as shown in FIG. 3.

One of conventional hair extensions using the weft (general type or individual type) is usually used in such a manner as to be extended to real hair by means of a chemical adhesive. However, the conventional method causes some problems that it needs excessive time to attach the wig hair to the real hair and it exhibits weak resistance against heat and chemicals.

Therefore, the conventional wefts for hair extension are used by the following methods: First, the weft is extended to the real hair by means of a clip or pincers that is (are) provided at the top end portion thereof; Second, the weft is provided with a plurality of separate pressure rings 50 that are mounted by use of a thread 51 at the top end portion thereof, each pressure ring having real hair inserted thereinto and pressed after the insertion of the real hair, as shown in FIG. 4; and third, the individual weft is extended to the real hair by means of a crochet needle 61 and a single individual pressure ring 50.

However, these methods of extending such the wefts for the hair extension have had the following disadvantages.

In case of extending the weft for hair extension to the real hair by the use of the separate pressure ring 50, the weft for hair extension is extended to the real hair just by the utilization of the force of the pressure ring 50, such that the wig hair may be separated from the real hair at any time. In addition, the individual wefts for hair extension one by one should be extended to the real hair, such that it requires a lot of time to finish the extension.

As shown in FIG. 4, a method of extending the weft for hair extension to real hair by the use of the plurality of separate pressure rings 50 that are mounted at the top end portion thereof by means of the thread 51 has the following problems.

The plurality of pressure rings 50 should be mounted by the use of the thread 51 at the top end portion of the weft, such that the production process of the weft becomes complicated, it is necessary to spend a lot of time and human powers, and the production costs are raised.

Once the pressure rings 50 are attached at the top end portion of the weft, it is necessary for nippers or long nose pliers to approach in a vertical direction to the top end surface of the weft so as to apply the pressure force to the pressure rings 50, such that it is difficult to apply the pressure force to the pressure rings 50 in an accurate manner. Therefore, in case where the weft for hair extension that has been already extended to the real hair is adjusted in length or separated from the real hair, the pressure rings should be completely cut to separate. This makes the pressure rings 50 difficult to be used again or even if possible, it is very inconvenient to use again.

Furthermore, since the weft has the top end portion back-stitched several times for the connection of the plurality of wig hair ties, the top end portion becomes hard, and in this state, the weft for hair extension further has the pressure rings 50 attached at the top end portion thereof, such that in case where the connected portion where the pressure rings 50 are mounted comes in contact with other objects, for example, in case where a user wearing the weft lies on the floor, he or she feels that his or her head gets hurt.

Additionally, even if one of the objects of the usage of the weft for hair extension is to get new beauty, the weft for hair extension 90 in the conventional method using the pressure ring 50 is positioned to the outside of the real hair 60, as shown in FIG. 6, which causes the pressure ring 50 to be lifted, such that the outer appearance becomes bad.

In line with this, U.S. Pat. No. 3,280,826 (Jenkims, Christina M. Oct. 25, 1966, patent date, "Hair Piece and Method of Making and Permanently Attaching Same",) introduces a method for attaching the hair piece to human hair using snap fastener (13). But, the hair piece and snap fastener (13) cause a human a foreign substantial sense.

To lessen foreign substantial sense, U.S. Pat. No. 5,121,761 (Meister, Karen L., Jun. 16, 1992, patent date, "Method For Attaching Hair Extension") introduces a method for binding the hair and extension (11) using ancher sleeve (29) and fixing the hair and the extension (11) with thread (47) using a curved niddle (49). But this method is inconvenience and take too much time, because as preceding, it binds the hair and extension (11) and fix those with niddle (49).

U.S. Pat. No. 5,921,253 (Jeong, Ho-Taeg, Jul. 13, 1999, patent date, "Method and device for making weft of weaving for wigs"), U.S. Pat. No. 6,135,122 (Campbell, Annie L, Oct. 24, 2000, patent date, "Self adhesive hair weft extension and method of Securing same"), and U.S. Pat. No. 6,405,736 (Townsent Valerie, Jun. 18, 2002, patent date, "Method of using a self adhesive weaving for wigs") are the method for bonding artificial hair and human hair using the adhesive, those referenced method are different from the invention because of connection media. The invention using weft and ring as the connection media which is pressed after connect weft and human hair. In this reason, the invention and those referenced invention are different.

SUMMARY OF THE INVENTION

Accordingly, the present invention is directed to a weft for hair extension and a method of extending the weft for hair extension to real hair that substantially obviates one or more problems due to limitations and disadvantages of the related art.

An object of the present invention is to provide a weft for hair extension and a method of extending the weft for hair extension to real hair that is produced in simple production process and in great quantities.

Another object of the present invention is to provide a weft for hair extension and a method of extending the weft for hair extension to real hair that is adjusted in length and used again in an easy manner.

Still another object of the present invention is to provide a weft for hair extension and a method of extending the weft for hair extension to real hair that does not provide any unpleasant feeling or hurt due to the contact with other objects.

Still yet another object of the present invention is to provide a weft for hair extension and a method of extending the weft for hair extension to real hair that is provided with extending portions that are not almost exposed to the outside, thereby making it possible to give a natural outer appearance.

To achieve the above objects, according to one aspect of the present invention, there is provided a weft for hair extension having a pair of wig hair bundles formed by connecting a plurality of horizontally arranged wig hair ties to one another at the top end portion thereof by means of a connecting thread and bound together by means of a binding thread, characterized in that the binding thread provides a plurality of binding portions equally spaced at predetermined intervals at the top end portions of the pair of wig hair bundles, each of the plurality of binding portions forming a space portion through which a crochet needle is passed between the pair of wig hair bundles.

According to another aspect of the present invention, there is also provided a method of extending the weft for hair extension to real hair, including the steps of: inserting the real hair into space portions of the weft for hair extension that are formed at the top end portion by binding a pair of wig hair bundles; applying an adhesive to the portions to be attached of the real hair after the insertion and to the wig hair bundles around the space portions; and bonding the portions of the real hair and the wig hair bundles to which the adhesive is applied with each other.

BRIEF DESCRIPTION OF THE DRAWINGS

Further objects and advantages of the invention can be more fully understood from the following detailed description taken in conjunction with the accompanying drawings, in which:

FIG. 1 is a perspective view of a pair of wig hair bundles forming a weft for hair extension;

FIG. 2 is a perspective of a conventional weft for hair extension wherein the pair of wig hair bundles have the top portion with no space portions;

FIG. 3 is a perspective view of a weft for hair extension with an individual wig hair tie;

FIG. 4 is a perspective view of the conventional weft for hair extension having a plurality of rings coupled at the top end portion thereof;

FIG. 5 is a perspective view of a method of extending a wig hair tie to real hair by use of a pressure ring;

FIG. 6 is an exemplary view of the extension of the conventional weft for hair extension to the real hair;

FIG. 7 is a perspective view of a weft for hair extension according to an embodiment of the present invention;

FIG. 8 is an exemplary view of a method of extending the weft for hair extension to real hair according to an embodiment of the present invention;

FIG. 9 is an exemplary view of a method of extending the weft for hair extension to real hair according to another embodiment of the present invention;

FIG. 10 is an exemplary view of a method of extending the weft for hair extension to real hair according to yet another embodiment of the present invention;

FIG. 11 is an exemplary view of a method of extending the conventional weft for hair extension to real hair by the insertion of pressure rings;

FIG. 12 is a perspective view of a weft for hair extension according to another embodiment of the present invention;

FIG. 13 is a perspective view of a weft for hair extension with an individual wig hair tie according to another embodiment of the present invention;

FIG. 14 is a perspective view of a weft for hair extension according to yet another embodiment of the present invention;

FIG. 15 is a perspective view of a weft for hair extension according to still another embodiment of the present invention;

FIG. 16 is a perspective view of a weft for hair extension according to another embodiment of the present invention;

FIG. 17*a* and FIG. 17*b* are a perspective view of a weft for hair extension according to still another embodiment of the present invention; and FIG. 18 is a perspective view of a weft for hair extension according to yet another embodiment of the present invention, wherein the real hair is inserted into the pressure rings at the inside of the weft thus to be extended to the weft.

DETAILED DESCRIPTION OF THE PREFERRED EMBODIMENT

Reference will now be made in detail to the preferred embodiments of the present invention, examples of which are illustrated in the accompanying drawings.

FIG. 7 shows a weft for hair extension according to an embodiment of the present invention. In the preferred embodiment of the present invention, as shown, a weft for hair extension having a pair of wig hair bundles formed by connecting a plurality of horizontally arranged wig hair ties 10 to one another at the top end portion thereof by means of a connecting thread 30 and bound together by means of a binding thread 40, the weft for hair extension characterized in that: the binding thread 40 provides a plurality of binding portions 41 equally spaced at predetermined intervals at the top end portions of the pair of wig hair bundles 20, each of the plurality of binding portions 41 forming a space portion through which a crochet needle is passed between the pair of wig hair bundles.

In other words, the conventional weft has the pair of wig hair bundles 20 just backstitched to bind up each other, without providing any space portions through which real hair is passed, as shown in FIG. 2, such that it is difficult to insert a crochet needle into the space portions formed between the pair of wig hair bundles 20 (in this case, the backstitches are the shape of 'x' or other ones in a zigzag sewing manner). However, the weft for hair extension according to the preferred embodiment of the present invention has the pair of wig hair bundles 20 backstitched to bind up each other, providing predetermined space portions through which the crochet needle and the real hair are passed, between the pair of wig hair bundles bound with each other. The space portions serve as binding portions 41. In normal cases, the pair of wig hair bundles 20 come in close contact with each other, but in case of pushing the crochet needle between the pair of wig hair bundles 20, the binding portions 41 provide the space portions through which the real hair is passed.

The weft for hair extension of the present invention provides the binding portions 41 at predetermined intervals at the top end portions of the pair of wig hair bundles 20, as shown in FIG. 7, which are formed by the backstitching at the predetermined intervals in a length direction of the wig hair ties 10.

According to the preferred embodiment of the present invention, in more detail, the binding portions 41 are formed in such a manner that the binding thread 40 is backstitched several times in the length direction of the wig hair ties 10.

As noted above, the weft for hair extension of this invention is basically different from the conventional weft where the pair of wig hair bundles 20 are backstitched like overlock at the whole top end portion thereof, without having any space portions therebetween.

At this time, the interval between the binding portion 41 and the adjacent one 41 is determined depending upon the size of the crochet needle and the real hair being passed through the binding portion 41, desirably in a range between 2 mm and 4 mm.

Referring to the method of extending the weft for hair extension according to the present invention to the real hair, the weft for hair extension has the space portions between the pair of wig hair bundles 20, as shown in FIG. 7, through which the real hair is passed and connected with the weft for hair extension for extension to the real hair.

In more detail, as shown in FIG. 8, the pair of wig hair bundles 20 have the space portions through which the real hair 60 is passed between them, and then, an adhesive 55 is applied to the portions to be bonded on the real hair 60 and to the space portions at the top of the pair of wig hair bundles 20. Next, the portions on the real hair 60 where the adhesive 55 is applied and the space portions of the pair of wig hair bundles 20 where the adhesive 55 is applied are bonded to each other, such that the weft for hair extension is extended to the real hair 60.

In other words, as shown in FIG. 8, the adhesive 55 is applied to the real hair 60 passed through the pair of wig hair bundles 20 and to the space portions of the pair of wig hair bundles 20, and the two portions where the adhesive 55 is applied are bonded to each other. In this case, the weft for hair extension is extended to the real hair by the use of the adhesive 55, so the outer appearance looks better than using the pressure rings as will be discussed later.

After it is extended to the real hair, however, it can be detached by utilization of separate chemicals, and also, there is a possibility that the adhesive may be bad to a user's scalp.

In another embodiment of the present invention, as shown in FIG. 9, the pair of wig hair bundles 20 have the space portions through which the real hair 60 is passed between them, and then, the pressure rings 50 are inserted into the portions to be bonded on the real hair 60 passed through the space portions of the pair of wig hair bundles 20. Next, the pressure rings 50 are fixedly fastened to the portions to be bonded on the real hair 60, such that the weft for hair extension is extended to the real hair 60.

In more detail, the real hair 60 to which the weft for hair extension is extended is passed through the space portions at the top of the weft by use of an instrument like a crochet needle, and the real hair after passing through the space portions is inserted into each of the pressure rings 50. Next, the pressure rings 50 are fastened by the use of an instrument like nippers or long nose pliers. In this case, each pressure rings 50 has a larger size than the space portion at the top of the weft, such that the weft is kept extended, without being deviated from the real hair.

In this extension method, however, since there is no separate portion for fixing the weft for hair extension itself, there is a possibility that the pressure rings 50 are turned, which unfortunately causes the user's scalp to get hurt. Also, in case where an excessive force is applied to the pressure rings 50, the pressure rings 50 may be escaped from the space portions (through which the real hair is passed by the use of the crochet needle) at the top of the weft.

In case of the individual weft for hair extension, of course, it does not almost turn, and even if it is turned temporarily, the pressure ring 50 is attached in a flat shape on the wig hair tie 10, without giving any bad influence to the user's scalp.

To solve the problem that the pressure rings 50 are turned, the present invention provides a method of extending the weft for hair extension according to another embodiment of the present invention, wherein each of the plurality of wig hair ties 10 is inserted into the pressure ring 50 together with the real hair 60 and after the insertion, the pressure rings 50 are fastened, as shown in FIG. 10.

When each of the plurality of wig hair ties 10 is inserted into the pressure ring 50 together with the real hair 60, the pressure rings 50 and the top end of the weft come in close contact with each other, thereby exhibiting a substantially rigid relationship with each other and preventing the turning of the weft. As a result, the weft for hair extension is kept without having any twisting even upon application of the impact from the downward direction, and it is not exposed to the outside, maintaining its stable position, thereby having the hair with the weft for hair extension dried, combed, curled and dyed.

As shown in FIG. 11, of course, in the conventional weft for hair extension each of the plurality of wig hair ties 10 is inserted into the pressure ring 50 and at the same time, the real hair 60 is inserted thereinto. Then, the pressure rings 50 are fastened to fix the weft for hair extension. In this case, however, when the real hair 60 and the weft are extended, the pressure rings 50 are lifted and thereby, its whole appearance gets bad, as shown in FIG. 6. So, the sense of unity between the weft and the real hair 60 is so low that a user cannot feel comfortable to the weft for hair extension.

Contrarily, in the method of extending the weft for hair extension to the real hair according to the present invention, the real hair 60 is passed through the space portions of the pair of wig hair bundles 20, such that the sense of unity between the weft and the real hair 60 is so high that the outer appearance of the hair with the weft for hair extension looks natural.

As noted above, the method of mounting the pressure rings 50 onto the conventional weft as shown in FIG. 4 has a problem that the pressure rings 50 are difficult to be fastened, but the method of extending the weft for hair extension to the real hair according to the present invention has the pressure rings 50 separated from the hard portion at the top of the weft, so that it is easy for an instrument like nippers to approach thereto and it is also easy to unfasten the pressure rings 50. This of course makes the weft for hair extension once extended well separated from the real hair 60.

At the same time, in case where the user with the real hair 60 extended to the weft for hair extension is sleeping, he or she does not get hurt even when the top end portion (hard portion) of the weft is depressed, which gives an excellent wearing feeling to him or her.

The method of extending the weft for hair extension to the real hair according to the present invention has solved the conventional problems, giving a lot of advantages that the weft for hair extension is easy to be mounted and demounted, it after mounting is adjusted in length, it can be recycled, and it is extended to the real hair with no unfamiliar feeling or hurt.

Furthermore, the conventional extension method where the pressure rings are mounted to the outside of the weft for hair extension for extension to the real hair does not give any sense of unity between the pressure ring and the weft for hair extension, so that the weft extended to the real hair through the pressure rings is turned or twisted. In order to prevent such the problems, the pressure rings 50 should be spaced away at substantially tight intervals.

In the process of making the weft with the pressure rings 50, therefore, the labor costs become high as a lot of time is required, and the production costs become high as the number of pressure rings consumed is increased.

Contrarily, the method of extending the weft for hair extension to the real hair according to the present invention gives a high sense of unity between the pressure ring and the weft for hair extension, so that the weft extended to the real hair is not twisted. Therefore, there is no need for mounting a large number of pressure rings. This enables all of the labor and production costs to be decreased, which is very economical.

Unlike the conventional extension method where the real hair is extended at the outside of the weft, the method of extending the weft for hair extension to the real hair according to the present invention where the real hair is passed through the space portions of the pair of wig hair bundles of the weft for hair extension ensures that the weft for hair extension is maintained at an excellent extension state to the real hair.

So as to insert the real hair 60 and each of the plurality of wig hair ties 10 into each pressure ring 50 at a time, as shown in FIG. 12, the weft for hair extension according to another embodiment of the present invention further includes the plurality of pressure rings 50 each being inserted into the plurality of wig hair ties 10 and a fixing thread 70 that is fixed to the top portion of the weft for preventing the plurality of pressure rings 50 from being deviated from the wig hair ties 10, the fixing thread 70 being passed through the plurality of pressure rings 50.

In other words, at the time when the weft for hair extension is manufactured the pressure rings 50 are first inserted into the wig hair ties 10 and then, the fixing thread 70 is mounted to tie the pressure rings 50 to the weft for hair extension such that the pressure rings 50 are not deviated from the wig hair ties 10, as shown in FIG. 12.

It can be appreciated that the weft for hair extension according to the present invention can mount the pressure rings 50 thereto in much easier manner when compared with the conventional weft for hair extension where the pressure rings 50 are mounted by using the thread at the top portion thereof. Therefore, the weft for hair extension according to this preferred embodiment of the present invention gives some advantages that the production process is very simple and the production is made in great quantities at low expense.

At this time, the weft for hair extension with the fixing thread 70 can be applied to the individual weft for hair extension, as shown in FIG. 13. In this case, the individual weft matches to the real hair very well, thereby obtaining a substantially natural appearance.

So as to mount the pressure rings 50 to the weft for hair extension in more convenient manner, as shown in FIG. 14, the weft for hair extension according to another embodiment of the present invention further includes the plurality of pressure rings 50 each being inserted into each of the plurality of wig hair ties 10 and detachable tape 80 that is provided at the low portions of the wig hair ties 10 into which the pressure rings 50 are inserted so that the pressure rings 50 are not deviated from the wig hair ties 10.

In this case, the pressure rings 50 are inserted into the wig hair ties 10, and the detachable tape 80 is just attached at the lower portions of the wig hair ties 10 into which the pressure rings 50 are inserted. Therefore, once the weft for hair extension is extended to the real hair 60, the detachable tape 80 is removed out of the lower portions of the wig hair ties 10.

This gives an advantage that the manufacturing process for the weft for hair extension is easier than that using the fixing thread 70.

Also, the weft for hair extension can be made for curled wig hair as well as straight wig hair. In case of the weft for hair extension for the curled wig hair, as shown in FIG. 15, it includes the plurality of pressure rings 50 each being inserted into each of the plurality of wig hair ties 10 and the lower portions of the wig hair ties 10 that are curled, thereby preventing the deviation of the pressure rings 50.

The pressure rings 50 are inserted correspondingly into the wig hair ties 10 and then, the wig hair ties 10 are curled, which prevents the pressure rings 50 into which the wig hair ties 10 are inserted from being deviated from the wig hair ties 10. In this case, the manufacturing process of the weft for hair extension is easiest among those mentioned above.

So as to mount the pressure rings 50 to the weft for hair extension in more convenient manner, as shown in FIG. 16, the weft for hair extension according to still another embodiment of the present invention inserts the plurality of pressure rings 50 into the plurality of wig hair ties 10 and moves a part of the each of the wig hair ties 10 passed through the pressure rings 50 toward the upper portion thereof, such that it is passed through the space portions of the pair of wig hair bundles 20 and moves downward again to be passed through the pressure ring 50.

In other words, the parts of the wig hair ties 10 are passed through the pressure rings 50 two times, with a result that the pressure rings 50 cannot be separated from the wig hair ties 10.

In this manner, there is no need for providing the separate fixing thread 70 or detachable tape 80 for securing the pressure rings 50.

So as to mount the pressure rings 50 to the weft for hair extension in more convenient manner, as shown in FIG. 17*a* and FIG. 17*b*, the weft for hair extension according to still yet another embodiment of the present invention mounts the plurality of pressure rings 50 at the lower end of a strip 100 made of fiber by use of the fixing thread 70 that passes through the pressure rings 50 and couples the pair of wig hair bundles 20 with the strip 100 with the pressure rings 50 by use of the binding thread such that the strip 100 is mounted between the pair of wig hair bundles 20 of the weft for hair extension.

In this manner, there is no need for insertion of the plurality of wig hair ties 10 into the pressure rings.

The weft for hair extension with the pressure rings in the variety of methods does not pass the real hair 60 through the space portions of the pair of wig hair bundles 20, but inserts the real hair 60 into the pressure rings 50 for extension to the real hair 60 at the outside thereof, as shown in FIG. 11 or for extension to the real hair 60 at the inside thereof, as shown in FIG. 18.

As shown in FIGS. 11 and 18, in case where the real hair 60 is not passed through the space portions of the pair of wig hair bundles 20 of the weft, the outer appearance after mounting is relatively bad when compared with the case where the real hair 60 is passed through the space portions thereof, and the sense of unity between the weft for hair extension and the real hair 60 becomes low. However, the connection process of the weft for hair extension to the real hair is achieved in a simple, convenient manner.

The foregoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

As clearly described above, the weft for hair extension and the method of extending the weft for hair extension to real hair according to this preferred embodiments of the present invention gives some advantages that the pressure rings are mounted with ease, the production process is very simple, and the production is made in great quantities at low expense.

Especially, the weft for hair extension according to the preferred embodiments of the present invention mounts the plurality of pressure rings at the lower end of the strip 100 made of fiber by use of the fixing thread 70 that passes through the pressure rings 50 and couples the pair of wig hair bundles 20 with the strip 100 with the pressure rings 50 by use of the binding thread such that the strip 100 is mounted between the pair of wig hair bundles 20 of the weft for hair extension. In this manner, there is no need for insertion of the plurality of wig hair ties 10 into the pressure rings, which enables the production process to be extremely simplified.

The weft for hair extension according to the preferred embodiments of the present invention can be produced in great quantities as the production process is so simplified at low production costs, which gives some advantages of excellent price competitiveness, a high degree of purchase, and domestic industrial development.

In case where the weft for hair extension of this invention is extended to the real hair, also, the extension is conducted with ease such that it gives some advantages that the time for extension of the weft is saved, no twisting of the weft occurs, the weft is adjusted in length after the extension and also used again.

After such the extension, a user does not have any unpleasant feeling so that he or she has his or her hair dyed, curled, dried, and showered at any time. Even when he or she sleeps or works, he or she does not hurt even upon the contact with the external impacts or objects, so that he or she can do something desired in a convenient manner.

As the real hair is passed through the space portions of the pair of wig hair bundles of the weft for hair extension of this invention, the outer appearance after mounting is very natural.

If necessary, it is possible for the real hair not to be passed through the space portions of the pair of wig hair bundles of the weft for hair extension of this invention, such that the connection process is very simplified and finished in a rapid, convenient manner.

What is claimed is:

1. A weft for hair extension comprising:

a pair of wig hair bundles formed by connecting a plurality of horizontally arranged wig hair ties to one another at a top end portion thereof by means of a connecting thread and bound together by means of a binding thread, wherein the binding thread provides a plurality of binding portions spaced at predetermined intervals at the top end portions of the pair of wig hair bundles and spaces being formed between adjacent binding portions so that real hair passes through; and pressure rings located below the spaces so that the real hair passes through both the spaces and the pressure rings.

2. The weft for hair extension according to claim 1, further comprising a plurality of pressure rings inserted into the plurality of wig hair ties and a fixing thread fixed to the top portion thereof for preventing the plurality of pressure rings from being deviated from the plurality of wig hair ties, the fixing thread being passed through the plurality of pressure rings.

3. The weft for hair extension according to claim 1, further comprising a plurality of pressure rings inserted into the plurality of wig hair ties and detachable tape provided at the low portions of the plurality of wig hair ties into which the pressure rings are inserted, for preventing the plurality of pressure rings from being deviated from the plurality of wig hair ties.

4. The weft for hair extension according to claim 1, further comprising a plurality of pressure rings inserted into the plurality of wig hair ties, lifting a part of each of the plurality of wig hair ties passed through the pressure rings toward the upper portion thereof such that it is passed through the space portions of the pair of wig hair bundles and is lifted down to be passed again through each of the pressure rings.

5. The weft for hair extension according to claim 1, further comprising a strip formed of a fiber, a plurality of pressure rings mounted at the lower end of the strip; and a fixing thread passing through the pressure rings for mounting the plurality of pressure rings onto the lower end of the strip, the strip with the pressure rings at the lower end thereof being provided between the pair of wig hair bundles of the weft for hair extension.

6. The weft of claim 1 wherein the plurality of pressure rings are attached to an elongated strip of material.

7. The weft of claim 1 wherein the plurality of pressure rings are attached to the wig hair ties.

8. A method of extending a weft for hair extension to real hair, the method comprising:

passing at least one bundle of real hair through a space formed between adjacent binding portions for binding a pair of wig hair bundles of the weft at a top end portion of the weft;

further passing the bundle of real hair through a plurality of pressure rings; and fastening the plurality of pressure rings.

9. The method according to claim 8, wherein the plurality of wig hair ties of the weft for hair extension are passed through the pressure rings through which the real hair has been passed, and the pressure rings after the insertion of the plurality of wig hair ties are fastened.

10. The method according to claim 8, wherein the plurality of pressure rings are attached to an elongated strip of material.

11. The method of claim 8 further comprising:

passing at least one bundle of wig hair through the pressure rings, wherein the pressure rings are fastened to the real hair and the wig hair passing through the pressure rings.

* * * * *